United States Patent [19]

Gilbert

[11] 4,073,057

[45] Feb. 14, 1978

[54] FOLDING BLADE KNIFE

[75] Inventor: Richard Gilbert, Dronfield Sheffield, England

[73] Assignee: Stanley Tools Limited, England

[21] Appl. No.: 784,068

[22] Filed: Apr. 4, 1977

Related U.S. Application Data

[63] Continuation of Ser. No. 713,407, Aug. 11, 1976, abandoned.

[30] Foreign Application Priority Data

Aug. 26, 1975 United Kingdom ..... 35245/75

[51] Int. Cl.[2] ..... B26B 5/00

[52] U.S. Cl. ..... 30/153; 30/157

[58] Field of Search ..... 30/153, 155, 156, 157

[56] References Cited

U.S. PATENT DOCUMENTS

| | | | |
|---|---|---|---|
| 2,276,026 | 3/1942 | Davidson | 30/153 |
| 3,702,501 | 11/1972 | Wood | 30/153 |

FOREIGN PATENT DOCUMENTS

| | | | |
|---|---|---|---|
| 617,824 | 2/1949 | United Kingdom | 30/153 |

*Primary Examiner*—Jimmy C. Peters

*Attorney, Agent, or Firm*—Prutzman, Hayes, Kalb & Chilton

[57] ABSTRACT

A folding blade knife comprising a blade member and two U-shaped guard members, the free ends of both U-shaped guard members being pivoted to the rear end of the blade member on mutually perpendicular non-intersecting axes, such that in storage the point of the blade member is enclosed in the folds of the two guard members, one guard member covering the blade edges of the blade member and the other guard member covering the faces of the blade member, characterized in that the two guard members and their pivotal axes are adapted and arranged so that the first guard member to be unfolded from the blade member is the guard member covering the faces of the blade member, the second guard member to be unfolded from the blade member being the guard member covering the blade edges of the blade member.

4 Claims, 35 Drawing Figures

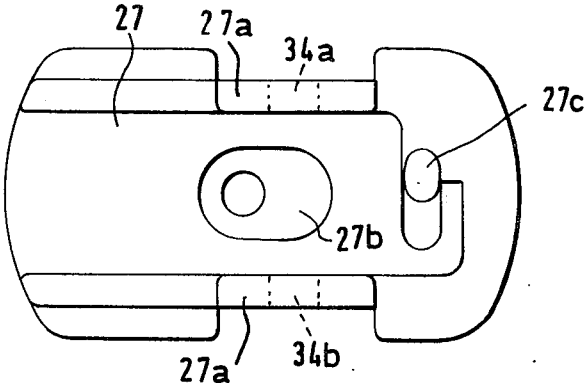
FIG. 20.
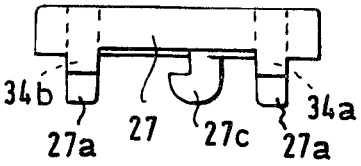
FIG. 21.
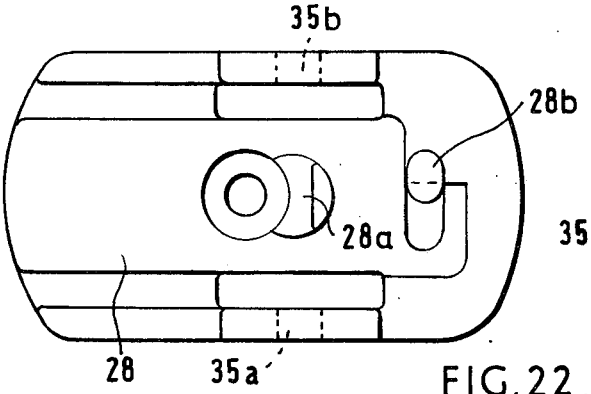
FIG. 22.
FIG. 23.
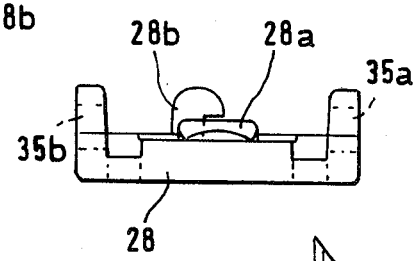
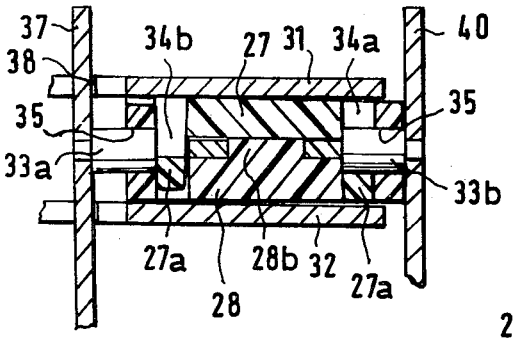
FIG. 24.
FIG. 26.
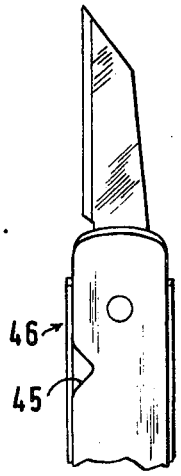
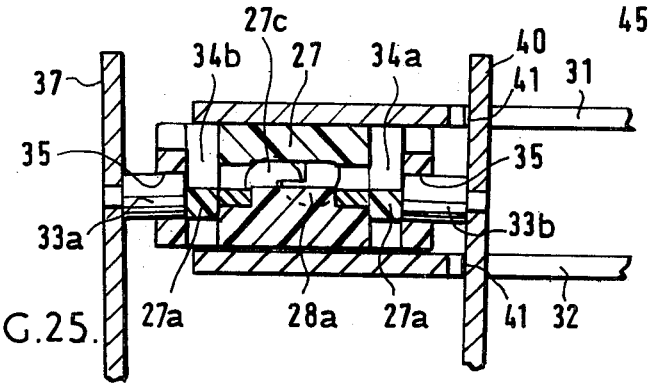
FIG. 25.

FOLDING BLADE KNIFE

This is a continuation application of copending application Ser. No. 713,407, filed Aug. 11, 1976, entitled "Folding Blade Knife", now abandoned.

FIELD OF THE INVENTION

This invention relates to a folding blade knife.

BACKGROUND OF THE INVENTION

A known folding blade knife comprises a blade member and two U-shaped guard members, the free ends of both U-shaped guard members being pivoted to the rear end of the blade member on mutually perpendicular non-intersecting axes, such that in storage the point of the blade is enclosed in the folds of the two guard members, one guard member covering the blade edges of the blade member and the other guard member covering the faces of the blade member. In this known folding blade knife, the first guard member to be unfolded from the blade member is the guard member covering the blade edges of the blade member, the second guard member to be unfolded from the blade member being the guard member covering the faces of the blade member. The user of the known knife is liable to cut himself on the sharp edge of the blade member when unfolding the second guard member. Furthermore, this known knife has no spring detent action to hold the guard members in position relative to the blade member, either when the blade member is in storage or when it is extended for use. Furthermore, the blade member is in one piece and cannot be replaced.

SUMMARY

According to the invention, there is provided a folding blade knife comprising a blade member and two U-shaped guard members, the free ends of both U-shaped guard members being pivoted to the rear end of the blade member on mutually perpendicular non-intersecting axes, such that in storage the point of the blade member is enclosed in the folds of the two guard members, one guard member covering the blade edges of the blade member and the other guard member covering the faces of the blade member, characterised in that the two guard members and their pivotal axes are adapted and arranged so that the first guard member to be unfolded from the blade member is the guard member covering the faces of the blade member, the second guard member to be unfolded from the blade member being the guard member covering the blade edges of the blade member.

Preferably, spring detent means are provided to hold the guard members in positional relationship with each other and with the blade member both in storage and unfolded. The spring detent means may be provided by bowing of the arms of the guard members.

Preferably the blade member comprises a replaceable blade and a blade holder. The blade holder may be in two parts respectively pivotally secured to the two arms of the guard member covering the faces of the blade member. Preferably the blade-edge-covering guard member has pivot pins engaging holes in the two parts of the blade holder, the pivot pins holding the said two parts of the blade holder together, to grip the blade, against springiness of the blade-face-covering guard member, so that manual splaying-apart of the edge-covering guard member, to withdraw the pivot pins (partially or completely) from the holes, allows the arms of the face-covering guard member and the two parts of the blade holder to spring apart, to release the blade. The two parts of the blade holder may be adapted to block re-entry of the pivot pins into the holes until the two arms of the face-covering guard member are manually squeezed together again.

BRIEF DESCRIPTION OF DRAWINGS

FIG. 20 is an inside view of one part of the blade holder, in the direction of arrow XX in FIG. 14;

FIG. 21 is an end view of the blade holder part of FIG. 20;

FIG. 22 is an inside view of the other part of the blade holder, in the direction of arrow XXII of FIG. 14;

FIG. 23 is an end view of the blade holder part of FIG. 22;

FIG. 24 is a section on line XXIV—XXIV of FIG. 6;

FIG. 25 is a section on line XXV—XXV of FIG. 7;

FIG. 26 is a scrap view, similar to FIG. 11, of one end of a modified folding blade knife embodying the invention;

DETAILED DESCRIPTION OF PREFERRED EMBODIMENTS

Figure 1:
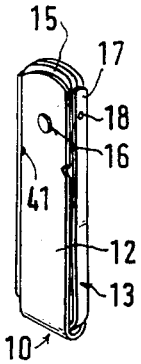
FIG. 1 illustrates a preferred folding blade knife embodying the invention, with the blade member in the storage position.

Referring to FIGS. 1 to 25 of the drawings, the folding blade knife 10 illustrated therein comprises a blade member 11 and two U-shaped guard members 12 and 13. The face ends 14 of guard member 12 are pivoted to the rear end 15 of blade member 11 on a pivot 16. The free ends 17 of guard member 13 are pivoted to the rear end 15 of blade member 11 on a pivot 18. The pivots 16 and 18 have mutually perpendicular non-intersecting axes, such that in storage the point 19 of blade member 11 is enclosed in the fold 20 of guard member 12 and the fold 21 of guard member 13.

The guard member 12 covers the faces 22 of blade member 11, whilst guard member 13 covers the sharp edge 23 and the rear edge 24 of blade member 11.

Figure 2:
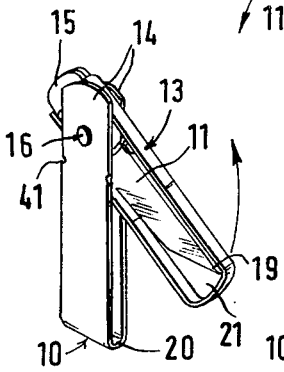
FIG. 2 shows the blade face-covering guard member being unfolded relative to the blade member.
Figure 3:
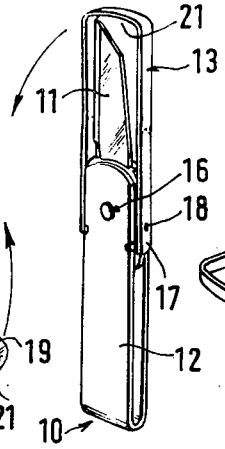
FIG. 3 shows the blade face-covering guard member fully unfolded from the blade member.
Figure 4:
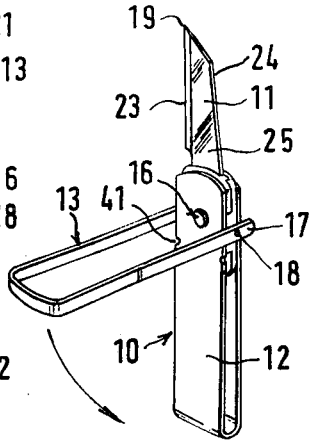
FIG. 4 shows the blade edge-covering guard member being unfolded from the blade member.
Figure 5:
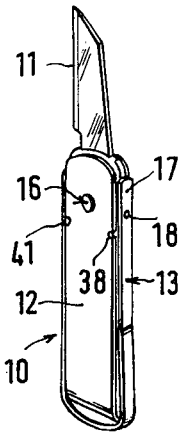
FIG. 5 shows the blade edge-covering guard member fully unfolded from the blade member.

The two guard members 12 and 13 and the mutually perpendicular, non-intersecting axes of their pivots 16 and 18 are adapted and arranged so that the first guard member to be unfolded from the blade member 11 is the guard member 12 covering the faces 22 of the blade member 11, as illustrated in FIGS. 2 and 3; the second guard member to be unfolded from the blade member 11 being the guard member 13 covering the blade edges 23 and 24 of the blade member 11, as illustrated in FIGS. 4 and 5.

The blade member 11 comprises a replaceable blade 25 and a blade holder 26. The blade holder 26 is in two parts 27 and 28 respectively pivotably secured by pivots 29 and 30 to the two arms 31 and 32 respectively of the guard member 12.

Figure 8:
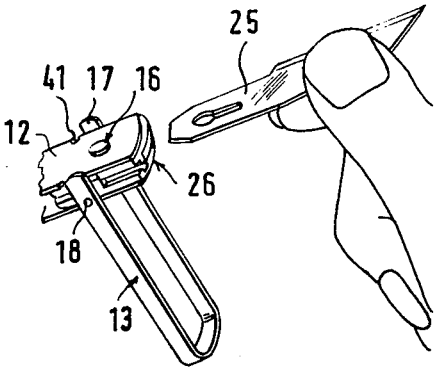
FIG. 8 illustrates the replaceable blade being withdrawn.
Figure 16:
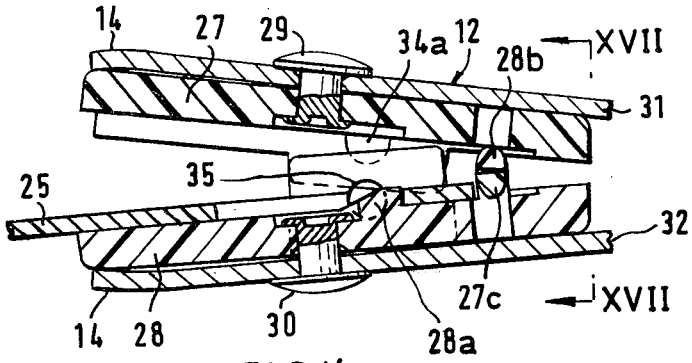
FIG. 16 is a longitudinal mid-section through the parts of FIG. 14, but showing them only partly splayed apart, and showing the replaceable blade in position.
Figure 17:
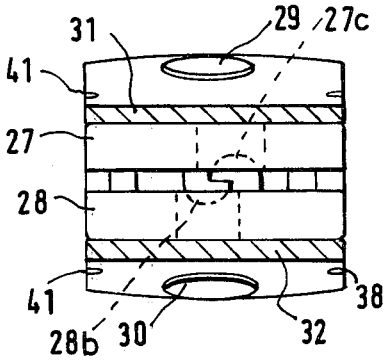
FIG. 17 is a section on line XVII—XVII of FIG. 16.
Figure 18:
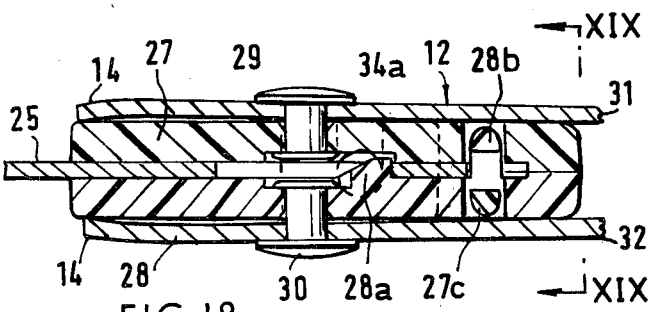
FIG. 18 is a longitudinal-mid-section corresponding to FIG. 16 but showing the parts fully closed together.
Figure 19:
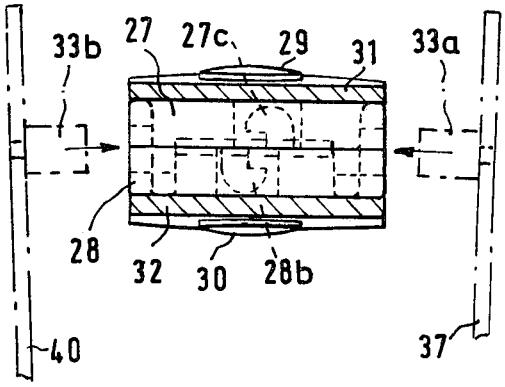
FIG. 19 is a section on line XIX—XIX of FIG. 18, and also showing in ghost outline the ends of the blade edge-covering guard member with its pivot pins.
Figure 27:
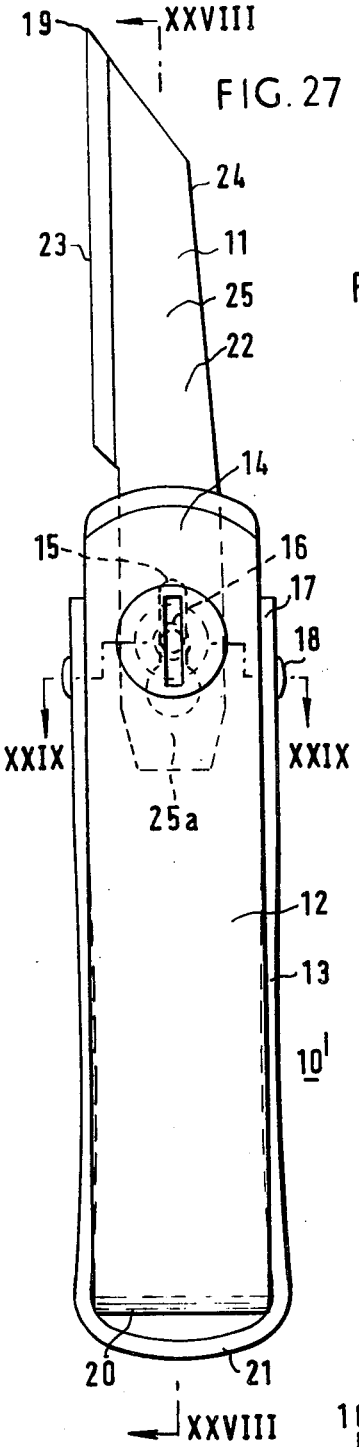
FIG. 27 is a side elevation of another modified knife with the guard members fully unfolded.

The guard member 13 has two pivot pins 33 engaging two pairs of holes 34 and 35 in blade holder parts 27 and 28 respectively, the pivot pins 33 holding the blade holder parts 27 and 28 together, to grip the replaceable blade 25, against springiness of the guard member 12, so that manual splaying-apart of the guard member 13, to withdraw the pivot pins 33 partially from the holes 34 and 35 in blade holder parts 27 and 28, allows the arms 31 and 32 of guard member 12 and the blade holder parts 27 and 28 to spring apart to the position shown in FIGS. 8, 16 and 17, to release the blade 25. As shown in FIGS. 24 and 25, the two blade holder parts 27 and 28 are adapted to block re-entry of the pivot pins 33 into the holes 34 and 35 until the two arms 31 and 32 of the guard member 12 have been manually squeezed together again. More particularly, portions 27*a* of blade holder part 27 obstruct the holes 35 in blade holder part 28, until the arms 31 and 32 are manually squeezed together again.

Figure 6:
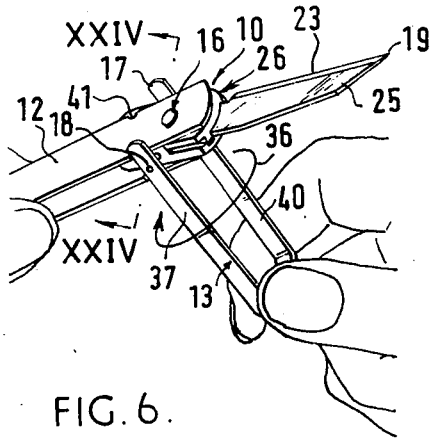
FIG. 6 illustrates the first stage in manipulation of the guard members to permit withdrawal of the replaceable blade of the blade member.
Figure 9:
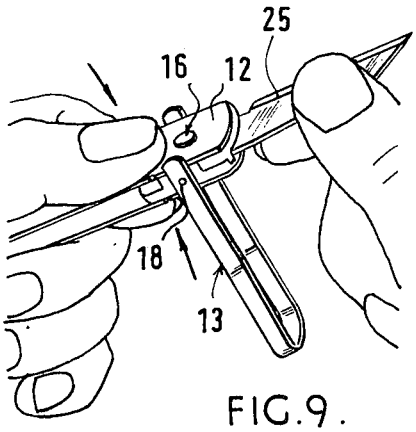
FIG. 9 illustrates the replaceable blade being replaced and the two arms of the face-covering guard member being manually squeezed together again.

In order to splay the guard member 13 manually apart, to withdraw the pivot pins 33 thereof partially from the holes 34 and 35, (or more particularly, completely from the holes 34 but not at all from holes 35,) the guard members 12 and 13 are pivoted to the mutually perpendicular positions shown in FIG. 4; then the guard member 13 is twisted in the direction shown by the circular arrow 36 in FIG. 6, until its arm 37 engages notches 38 in the edges of guard member 12. This action withdraws one of the pivot pins 33*a* from the corresponding hole 34*a* in blade holder part 27, as shown in FIG. 24; then the guard member 13 is twisted in the opposite direction, as indicated by the circular arrow 39 in FIG. 7, until the arm 40 enters notches 41 in the edges of guard member 12, causing withdrawal of the other pivot pin 33*b* from the corresponding hole 34*b*, as shown in FIG. 25. The blade 25 can now be withdrawn from between the blade holder parts 27 and 28, as shown in FIG. 8. When the blade 25 is replaced between the blade holder parts 27 and 28 and the arms 31 and 32 of guard member 12 are squeezed together, as shown in FIG. 9, the parts 27*a* move out of the way of the pivot pins 33, which enter the holes 34 under the springiness of guard member 13, thereby holding the blade holder parts 27 and 28 together.

The pivots 29 and 30 are formed by rivets, which are required to be somewhat loose to enable the blade holder parts 27 and 28 to come apart in the two stages illustrated in FIGS. 24 and 25.

Figure 10:
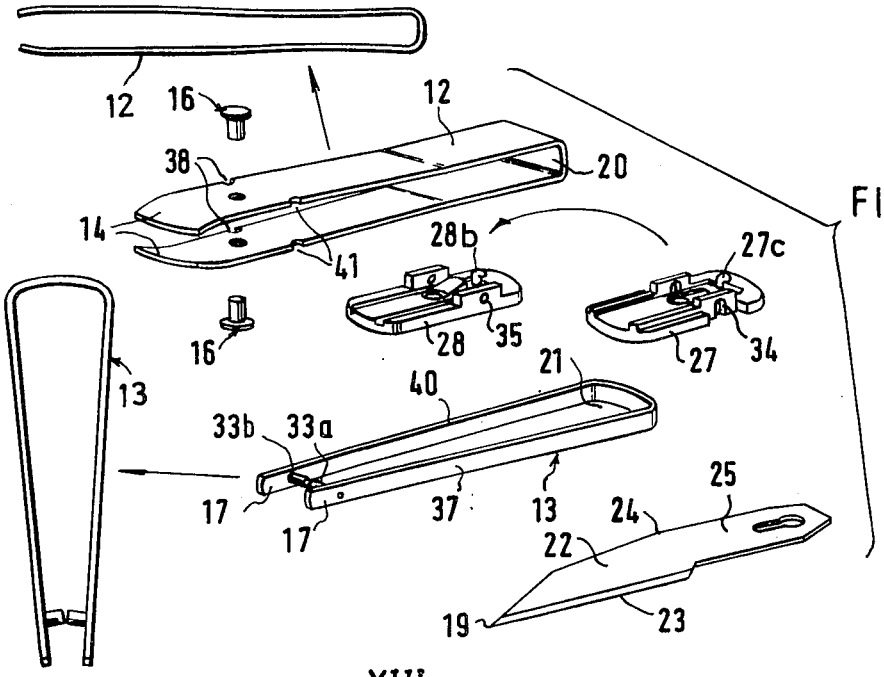
FIG. 10 is an exploded perspective view of the various parts of the knife.

Prior to assembly together of the parts of the knife 10, as illustrated in FIG. 10, the arms 31 and 32 of the guard member 12 are bowed. More particularly, the arms 31 and 32 are substantially parallel adjacent the fold 20, then diverge apart towards the notches 38 and 41, and then converge again towards the free ends 14. This has the effect that, when the knife 10 is assembled, intermediate portions 42 (FIG. 12) of arms 31 and 32 are inwardly bowed, holding the arms 31 and 32 of guard member 12 in between the arms 37 and 40 of guard member 13 with a spring detent action in the folded, storage position of FIG. 1.

Figure 11:
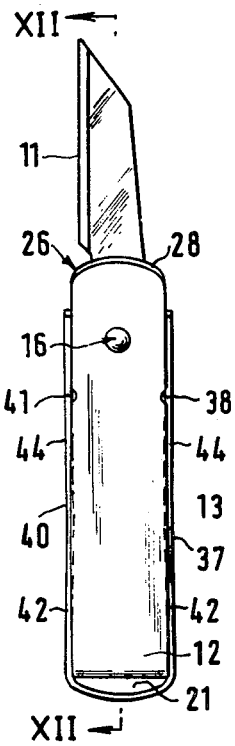
FIG. 11 is a side elevation of the knife with the guard members fully unfolded.
Figure 12:
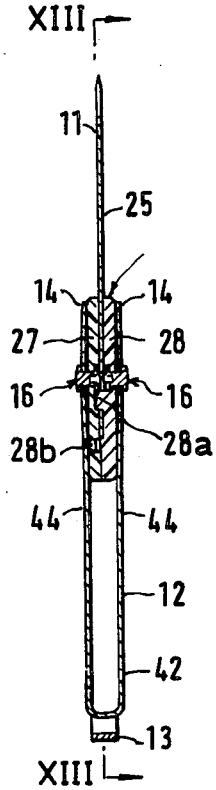
FIG. 12 is a section on line XII—XII of FIG. 11.
Figure 13:
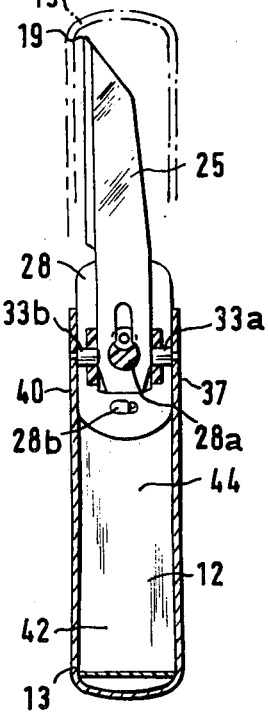
FIG. 13 is a section on line XIII—XIII of FIG. 12, in front of the replaceable blade.

The arms 37 and 40 of guard member 13 converge towards each other away from the fold 21 before the knife 10 is assembled, as shown in FIG. 10. In addition to the inward spring bias upon pivot pins 33 which this provides, when the knife 10 is assembled, it also causes intermediate portions 44 of the arms 37 and 40 to be inwardly bowed as shown in FIG. 13, to engage between the arms 31 and 32 of guard member 12 to hold the guard members 12 and 13 in positional relationship when fully unfolded as shown in FIGS. 11, 12 and 13.

Figure 7:
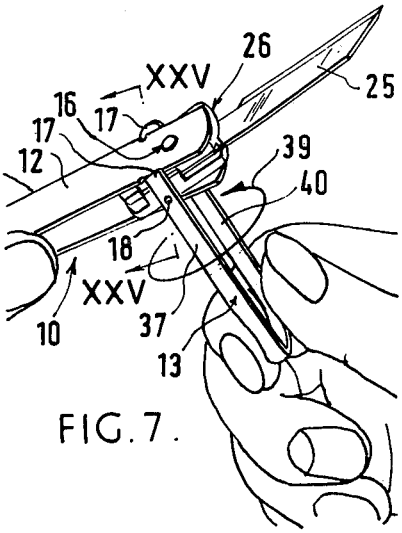
FIG. 7 illustrates a second stage in this manipulation.
Figure 14:
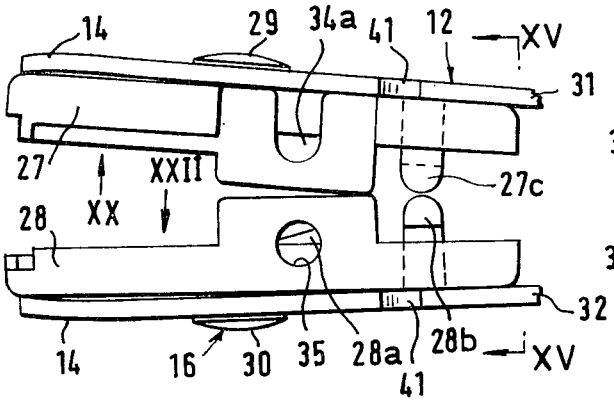
FIG. 14 is an enlarged side elevation of the two parts of the blade holder of the blade member, secured pivotally to the ends of the two arms of the face-covering guard member, fully splayed apart.
Figure 15:
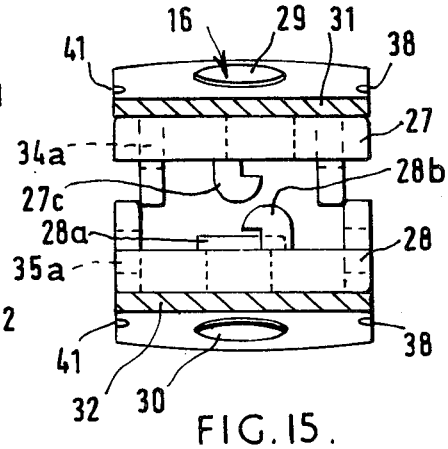
FIG. 15 is a section on line XV—XV of FIG. 14.

It will be apparent that the blade 25 is located upon a protuberance 28*a* in the blade holder part 28, receivable in a recess 27*b* in blade holder part 27. The blade holder parts 27 and 28, which are of moulded plastic, are formed with hooks 27*c* and 28*b* respectively, which inter-engage as shown in FIG. 25 when the knife 10 is manipulated as shown in FIGS. 6 and 7, so as to limit the extent to which the blade holder parts 27 and 28 separate from each other. Although FIGS. 14 and 15 show these hooks 27*c* and 28*b* completely separated, this is not normally intended to be done, except when the knife 10 is first assembled together. An additional function of the hooks 27*c* and 28*b* is to act as a backstop for the blade 25 when the blade is inserted between the blade holder parts 27 and 28.

Referring to FIGS. 1 to 5, it will be apparent that the user's hands are protected from being cut by the sharp edge 23 during the stage shown in FIGS. 2 and 3, when guard member 12 is unfolded from the blade member 11, and that the subsequent stage, shown in FIGS. 4 and 5, when the guard member 13 is unfolded from the blade member 13, is unlikely to result in a cut hand.

In the modification illustrated in FIG. 26, the two pairs of notches 38 and 41 are replaced by a single pair of larger notches 45 in the modified knife 46, which is in other respects identical to the knife 10 of FIGS. 1 to 25. The notches 45 have the effect that a single twisting action (as in FIG. 6, but twisting the blade edge-covering guard member further round than in FIG. 6,) is all that is required for both pivot pins to be partially withdrawn, substantially simultaneously, from the holes in the blade holder parts.

Although the pivots 29 and 30 are shown as tubular rivets, alternatives are possible, such as ultrasonically welded plastic rivets integral with the blade holder parts 27 and 28, or such as screws.

Referring to FIGS. 27 to 35 of the drawings, there is illustrated a modified folding blade knife 10' which is similar to the folding blade knife 10 of FIGS. 1 to 25 in most respects, corresponding parts and features of the two knifes 10 and 10' consequently bearing the same references. However, in place of the blade holder 26 of knife 10, there is a modified blade holder 26' in knife 10', comprising two parts 27' and 28' respectively pivotably secured by pivots 29' and 30' to the two arms 31 and 32 respectively of the guard member 12, pivots 29' and 30' forming the pivot 16 in this case (just as pivots 29 and 30 of blade holder 26 form the pivot 16 of the knife 10 of FIGS. 1 to 25).

Figure 28:
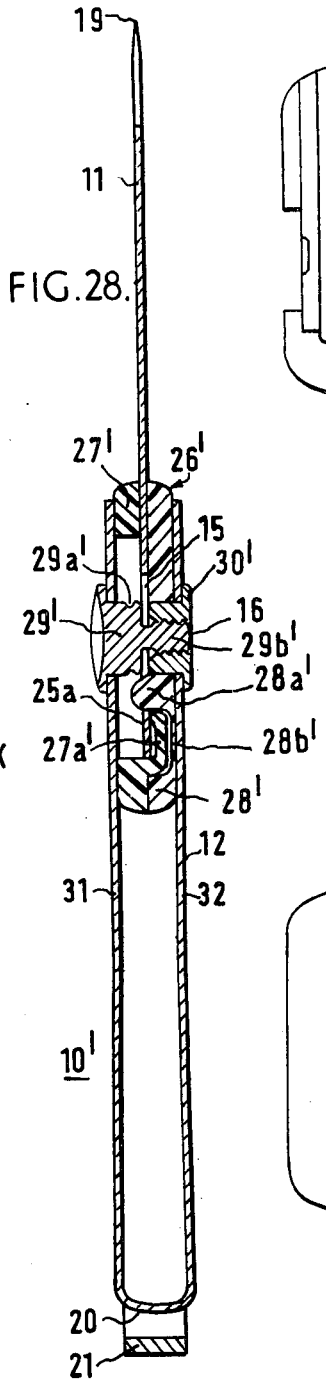
FIGS. 28 and 29 are respectively sections on lines XXVIII—XXVIII and XXIX—XXIX of FIG. 27.
Figure 30:
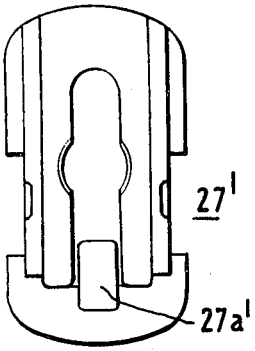
FIGS. 30, 31 and 32 are respectively an inside view, a side elevation and an outside view of one of the blade holder parts of FIGS. 27 to 29.
Figure 31:
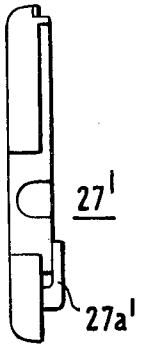
Figure 32:
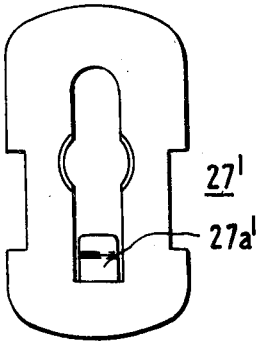
Figure 33:
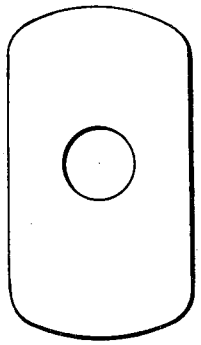
FIGS. 33, 34 and 35 are respectively an outside view, a side elevation and an inside view of the other blade holder part of FIGS. 27 to 29.
Figure 34:
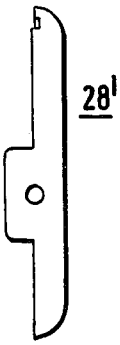
Figure 29:
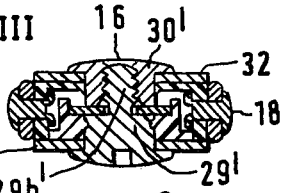
Figure 35:
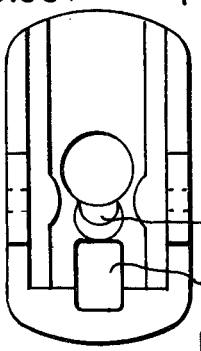

The pivot 29' is a screw headed member which extends through an aperture in the arm 31 and is formed with a groove **29*a'* (FIG. 28) which is filled by material of blade holder part 27' as shown in FIG. 29, to hold together the blade holder part 27' pivot 29' and arm 31**.

The pivot 30' is a headed nut which is an interference fit in the blade holder part 28', thereby holding together the blade holder part 28' pivot 30' and arm 32. The pivot 29' has an externally threaded extension **29*b'* which can be screwed into the nut 30' to assemble the knife 10' together, and can be unscrewed therefrom for the purpose of changing the blade 11**.

The blade holder part 27' is formed with a tongue **27*a'*, under which the rear end 25*a* of the replaceable blade 25 is fitted, as shown in FIG. 28**.

The blade holder part 28' includes a protruberance **28*a'* which extends through the keyhole slot (see FIG. 10) of the blade 25 to prevent displacement of the blade 25. Blade holder part 28' also has a recess 28*b'* to receive the tongue 27*a'* of blade holder part 27'**.

Whilst it is rather more time consuming to change the blade 25 in the knife 10' of FIGS. 27 to 35 than in the knife 10 of FIGS. 1 to 25, or the knife of FIG. 26, the knife 10 has the advantage that it is more obvious to a user of the knife as to how to take the knife apart for changing the blade, because the screw headed pivot 29' is obviously intended to be unscrewed from the pivot 30'. Furthermore, the knife 10' is less liable to male function than the knife 10 as regards dismantling the knife and reassembling it when changing the blade.

I claim:

1. A folding blade knife comprising, in combination:

a blade and a pivot for mounting the blade;

a first generally U-shaped guard member having arms, the free ends of which are pivotally connectable with the pivoted end of the blade to enable relative pivoting of the blade and said first guard member about a first axis to a first relative position in which the blade is stored between the arms of said first guard member and to a second relative position in which the blade is uncovered by said first guard member;

and a second generally U-shaped guard member having arms, the free ends of which are pivotally connectable with the pivoted end of the blade to enable the relative pivoting of the blade and said second guard member about a second axis which is perpendicular to but non-intersecting with said first axis to a first relative position in which the blade is stored between the arms of said second guard member and to a second relative position in which the blade is uncovered by said second guard member;

one of said guard members having its U-shaped end covered by the other of said guard members when the blade is stored by both guard members and the other of said guard members having its U-shaped end covered by the said one of said members when the blade is uncovered by both guard members;

an intermediate portion of at least one of the arms of one of said guard members projecting inwardly to engage the arms of the other of said guard members to latch the guard members together when the blade is in at least one of its relative positions with respect to both of said guard members.

2. The folding blade knife of claim 1 including a blade holder for pivotally mounting the blade with each of said pivots.

3. The folding blade knife according to claim 1 in which the knife blade is replaceable.

4. The folding blade knife according to claim 1 wherein the guard members are latched together when the blade is in an uncovered relative position with respect to both of said guard members.

* * * * *